US005606962A

United States Patent [19]

Troncoso

[11] Patent Number: 5,606,962

[45] Date of Patent: Mar. 4, 1997

[54] ARCHERY ARROW REST

[75] Inventor: Vincent Troncoso, Montrose, Colo.

[73] Assignee: Golden Key Futura, Inc., Montrose, Colo.

[21] Appl. No.: 569,930

[22] Filed: Dec. 8, 1995

[51] Int. Cl.[6] ..... F41B 5/00

[52] U.S. Cl. ..... 124/44.5; 124/24.1

[58] Field of Search ..... 124/24.1, 44.5, 124/44.1

[56] References Cited

U.S. PATENT DOCUMENTS

| | | | |
|---|---|---|---|
| 3,935,854 | 2/1976 | Troncoso . | |
| 4,236,497 | 12/1980 | Troncoso . | |
| 4,398,528 | 8/1983 | Troncoso . | |
| 4,686,956 | 8/1987 | Troncoso, Jr. | 124/44.5 |
| 4,949,699 | 8/1990 | Gerber | 124/24.1 X |
| 5,022,378 | 6/1991 | Rhodehouse et al. | 124/24.1 X |
| 5,161,515 | 11/1992 | Hammonds . | |
| 5,213,090 | 5/1993 | Tone | 124/24.1 X |
| 5,400,763 | 3/1995 | Mazza | 124/24.1 X |

*Primary Examiner*—Randolph A. Reese
*Assistant Examiner*—Thomas A. Beach
*Attorney, Agent, or Firm*—Donald E. Nist

[57] ABSTRACT

The improved archery arrow rest includes a support assembly which preferably includes a support block, the front portion of which is releasably attachable to the sidewall of the riser of an archery bow in the area defining the arrow window. The support assembly also includes a transverse bar connected to the rear end of the block and preferably laterally adjustable. The bar extends behind the riser to a point behind the arrow window. The rest further includes an arrow shaft holder connected to the bar and extending upwardly and forwardly thereof to project into the arrow window. The shaft holder has a pair of arcuate arms, the rear portions of which overlap and the front ends of which arms are spaced apart an adjustable distance. The shaft holder is preferably generally horseshoe shaped. Preferably, the rear ends of the arms are relasably pinned together and to the bar at two spaced points, as by screws, so that loosening of both screws is necessary in order to be able to pivot the arms to adjust the distance between the front ends of the arms to accommodate arrow shafts of various diameters. The bar may be spring biased and each of the arms can be divided into a rigid rear portion and a rotatable front portion in order to change the angle of inclination of the front ends of the arms to each other. Preferably, the arms are rigid flat blades with expanded abutting portions fitted with click-stop faces.

10 Claims, 2 Drawing Sheets

FIG. 1
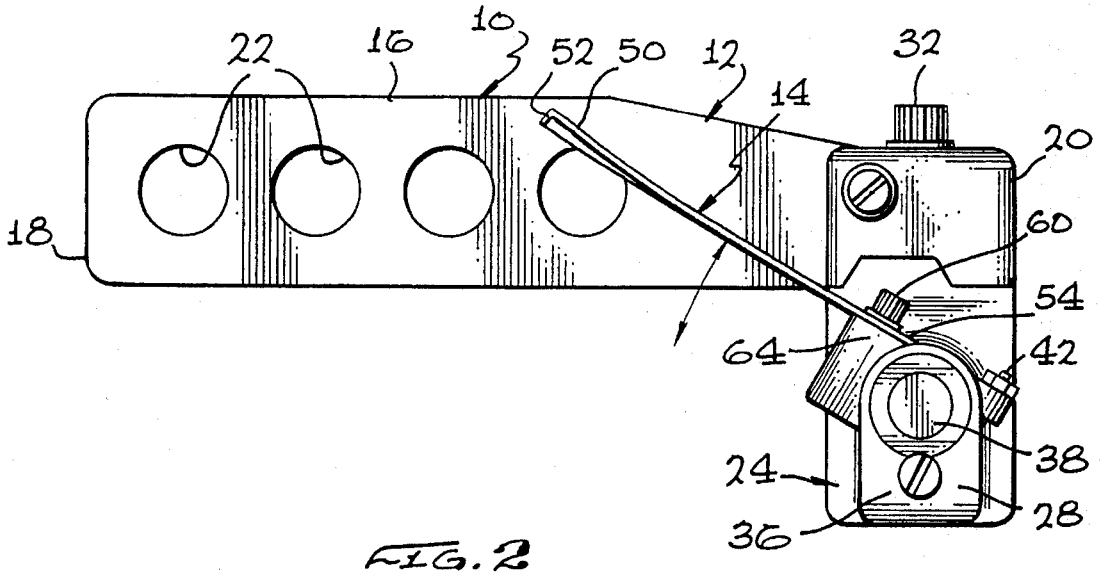
FIG. 2
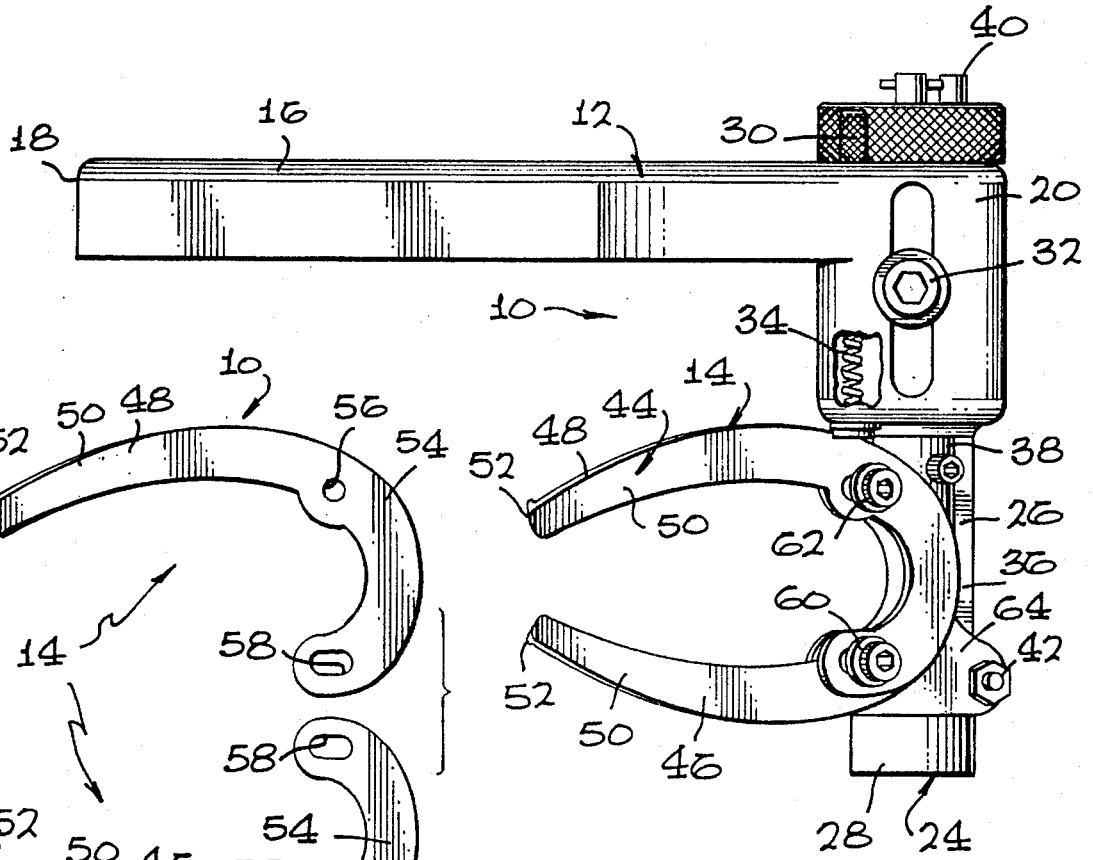
FIG. 3

ARCHERY ARROW REST

BACKGROUND OF THE INVENTION

1. Field of the Invention

The present invention generally relates to sports equipment and more particularly to an improved type of archery arrow rest.

2. Prior Art

Various types of archery arrow rests have been designed and utilized. One of the older types of archery arrow rests comprises a simple horizontal shelf of plastic, wood, feathers or the like attached to the sidewall of the riser of an archery bow and extending laterally into the the arrow window in the riser. Unfortunately, such an arrow rest does not perform well, due in part to archer's paradox, that is, the tendency of the arrow, when shot, to bend rapidly back and forth in a horizontal plane, so that the rest serves as a striking point for the arrow shaft and/or rear arrow vanes, throwing the arrow off line and making it inaccurate.

Newer archery arrow rests have used spring-biased side plungers, vertically depressible arrow shaft supports and the like to help the arrow shaft and vanes to clear the arrow rest during the act of shooting. Certain of such arrow rests have been adjustably positioned in the arrow window away from the sidewall in order to prevent the arrow shaft and/or vanes from striking such sidewall during shooting.

While many of the newer arrow rests have overcome certain of the problems of supporting the arrow for shooting in a manner which enables the arrow to clear the bow without interference with the arrow rest during .shooting, no conventional arrow rest exhibits all of the properties sought in the ideal arrow rest.

In this regard, many of such arrow rests are complicated, expensive, difficult to adjust and difficult to stay in adjustment. Yet one of the features important in a modern arrow rest is to be able to adjust the spacing between the portions Of the rest upon which the arrow shaft sits in order to accommodate arrow shafts of various diameters. Optimal shooting performance and accuracy demand that the archery bow be properly tuned with respect to the characteristics of the arrow used therewith. This tuning, in part, depends on how the arrow sits on the arrow rest, how well the arrow rest is aligned with the longitudinal centerline of the bow, etc.

When adjustments are made in the rest during fine tuning of the bow, such adjustments should be easily made, be reproducible and should stay in place during extensive shooting with the bow. Such criteria have not been met with conventional arrow rests.

Accordingly, it would be desireable to provide an improved arrow rest capable of providing the desired adjustments easily, rapidly, inexpensively and durably.

SUMMARY OF THE INVENTION

The improved archery arrow rest of the present invention satisfies all the foregoing needs. The rest is substantially as set forth in the ABSTRACT OF THE DISCLOSURE.

Thus, the arrow rest comprises one which has the following major components:

a) Means for releasably securing the rest to the sidewall of an archery bow in the riser portion thereof defining an arrow window. Such means preferably includes the following: (1) a mounting block having an elongated configuration and extending from the front end thereof which is releasably secured to the riser sidewall, as by screws or the like, to the rear end thereof which is behind the riser; and, (2) a crossbar extending transversely behind the riser to a point behind the arrow window and connected to the rear end of the mounting block, preferably in a manner which permits adjustment of the lateral position of the crossbar.

b) An arrow shaft holder, the rear end of which is secured to the crossbar free end and which extends upwardly and forwardly of the crossbar into the arrow window. Preferably, the crossbar is spring biased to, in turn, spring bias the arrow shaft holder against rotation of its front end downwardly during shooting of an arrow therefrom. The arrow shaft holder has a pair of arms, the front ends of which are spaced apart an adjustable distance and the rear portions of which are overlapped and releasably secured to the crossbar, as by screws, preferably at two or more spaced points. This is to prevent the spacing between the arms from changing except when both screws are loosened. The arms are preferably of thin relatively inflexible metal or the like and also preferably have front portions which rotate relative to the fixed rear portions thereof in order to adjust the angle of the front ends of the arms for better arrow shaft support. Those front ends can end in bent tips or the like. The points of connection of the front and rear portions of the arms may be equipped with click-stop means for precise control of the rotation and releasable holding of the arms in the desired rotated position.

Various other features of the improved archery arrow rest of the present invention are set forth in the following detailed description and accompanying drawings.

DRAWINGS

FIG. 1 is a schematic side elevation of a first preferred embodiment of the improved archery arrow rest of the present invention;

FIG. 2 is a schematic top plan view of the arrow rest of FIG. 1;

FIG. 3 is a schematic top plan view of the arms of the rest of FIG. 1, showing the arms separated;

DETAILED DESCRIPTION

FIGS. 1–4

Figure 4:
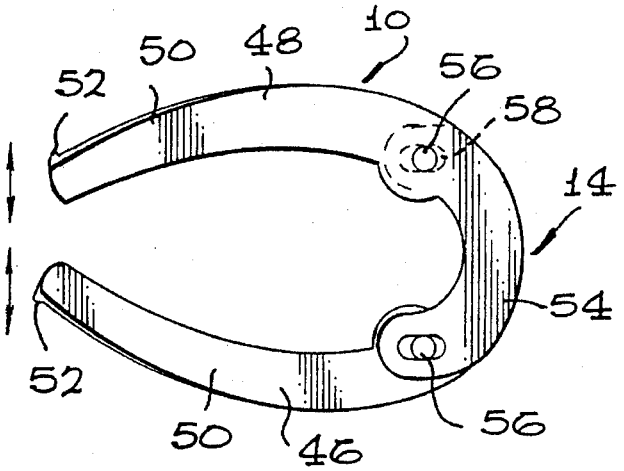
FIG. 4 is a schematic top plan view of the arms of the rest of FIG. 1, showing the arms in the overlapped position.

Now referring more particularly to FIGS. 1–4 of the drawings, a first preferred embodiment of the improved archery arrow rest of the present invention is schematically depicted therein. Thus, rest 10 is shown, which comprises an arrow rest support assembly 12 and an arrow shaft holder 14.

Support assembly 12 preferably comprises two main components:

a) an elongated block 16 having a front end 18 and a rear end 20. Block defines a plurality of spaced openings 22 extending transversely therethrough along the length thereof. Openings 22 are utilized to secure, as by screws (not shown) end 18 of block 16 to the sidewall (not shown) of an archery bow riser (not shown) in the area bordering an archery arrow window (not shown) so that block 16 extends rearwardly of the riser.

b) a transverse crossbar 24, one end 26 of which is connected to rear end 20 of block 16 and having a free end 28 extending to a position behind the archery arrow window when rest 10 is mounted on the archery bow. Crossbar 24 can be journelled to block 16 so as to be moveable transversely and thus be capable of adjusting the position of free end 28 behind the arrow window.

For such purposes, a turn wheel 30 and set screw 32 can be provided, as shown in FIG. 2. Crossbar 24 may also be spring biased for rotation,. as by an internal spring 34. Thus, crossbar 24 includes a fixed frame 36 within which portion 38 of crossbar 24 rotates, its extent of rotation being limited by limit pins 40 and 42.

Arrow rest 10 also includes an improved arrow shaft holder 44. Holder 44 is generally horseshoe shaped and includes a pair of arcuate preferably C-shaped arms 46 and 48, the front ends 50 of which have bent tips 52 and the rear ends 54 of which overlap. Tips 52 are adapted to smoothly hold the lower opposite sides of an arrow shaft (not shown). The rear end 54 of arm 48 overlaps the rear end 54 of arm 46 in the assembled condition shown in FIGS. 1, 2 and 4. When so assembled, the circular opening 56 in rear end 54 of arm 48 is aligned with oval opening 58 in the rear end 54 of arm 46, while the oval opening 58 in rear end 54 of arm 48 is aligned with circular opening 56 in the rear end 54 of arm 46.

Set screws 60 and 62 pass through the aligned openings to releasably secure both arms 46 and 48 in a fixed position to the top 64 of rotatable portion 38 of crossbar 24 so that arms 46 and 48 extend upwardly and forwardly thereof into the archery arrow window.

Front ends 50 of arms 46 and 48 are spaced apart an adjustable distance so as to accommodate arrow shafts of various diameters. In order to adjust the width between ends 50, both set screws 60 and 62 must be loosened and then ends 50 can be moved toward or away from each other, after which set screws 60 and 62 are tightened. This ability to move ends 50 toward and away from each other is due to the shape of openings 58. It will be understood that if only one set screw 60 or 62 is loosened, arms 46 and 48 retain their rigid relative fixed positions. This assures that the position of ends 50 will not inadvertantly shift and thus is a safety precaution not found in other archery arrow rests.

When an archery arrow held on tips 52 is shot from an archery bow to which rest 10 is connected, the arrow tends to press down against tips 52 and is resisted by the spring biasing of portion 38 to which arms 46 and 48 are connected, thereby increasing the accuracy of shooting utilizing rest 10. Arms 46 and 48 can be made of any suitable durable material, preferably relatively thin flat metal such as spring steel or the like, with little or a controlled amount of resiliency, as desired. This also favorably affects the flight characteristics of an arrow shot from rest 10.

Rest 10 permits arms 46 and 48 to be easily adjusted and replaced, as needed. Rest 10 also assures that because of the two point securing of arms 46 and 48 to crossbar portion 38 through set screws 60 and 62, rest 10 will remain stable during repeated use.

FIGS. 5–7

Figure 5:
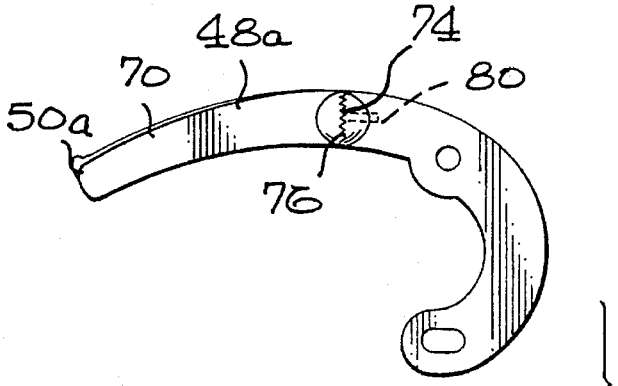
FIG. 5 is a schematic top plan view of a modified form of the arms of the rest of the present invention, showing the arms separated.
Figure 7:
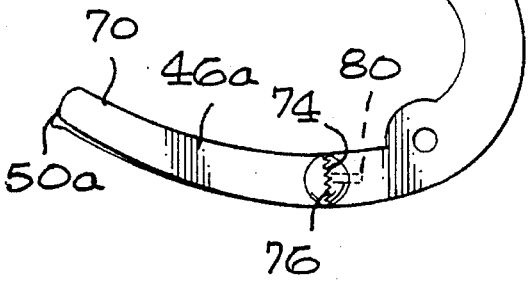
Figure 6:
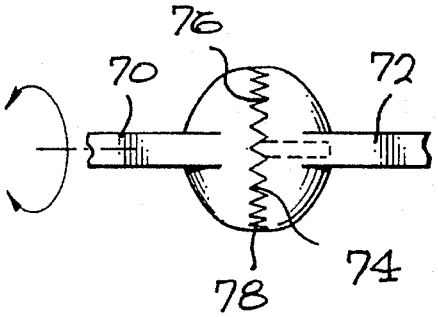
FIG. 6 is an enlarged, fragmentary, schematic top plan view, partly broken away, of one of the arms of FIG. 5; and, FIG. 7 is an enlarged, fragmentary, schematic side elevation, partly broken away, of the arm of FIG. 6.
Figure 6:
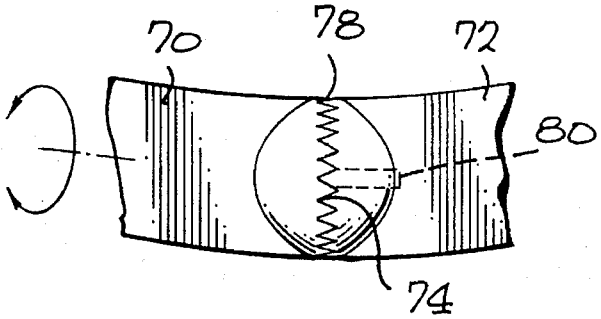

A modified form of the holder arms utilized in the arrow rest of the present invention are schematically set forth in FIGS. 5–7. Thus, arms **46*a* and 48*a* are shown. Such arms can be substituted for arms 46 and 48, if desired. Components of arms 46*a* and 48*a* similar to those of arms 46 and 48** bear the same numerals but are succeeded by the letter "a".

Arms **46*a* and 48*a* are substantially identical to arms 46 and 48**, except as follows:

a) Arms **46*a* and 48*a* are each divided into abutting front portions 70 and rear portions 72**;

b) The abutting faces 74 and 76 of portions 70 and 72, respectively, are expanded into circular configurations and bear roughened surfaces to provide click stop projections 78 which permit portions 70 to be incrementally rotated relative to portions 72 and to hold their rotated positions, portions 70 being journalled to portions 72 by pins 80. With this arrangement, when arms **46*a* and 48*a* are secured to the crossbar, portions 70 can be rotated to change the angle of inclination of tips 52*a* toward each other to improve the arrow shaft holding ability of arms 46*a* and 48*a*. Arms 46*a* and 48*a* have the other advantages of arms 46 and 48**.

Other features of the improved rest of the present invention are as set forth in the foregoing. Various other modifications, changes, alterations and additions can be made in the improved arrow rest of the present invention, its components and parameters. All such modifications, changes, alterations and additions as are within the scope of the appended claims form part of the present invention.

What is claimed is:

1. An improved archery arrow rest, said rest comprising, in combination:

a) an arrow rest support assembly comprising (1) a support block having a front end and an opposite rear end and including means for releasably connecting the front end of'said block to a riser of an archery bow and (2) a transverse bar connected to said rear end of said support block and adapted to extend behind an archery bow riser to a position rearwardly of an arrow window in said riser; and, b) an arrow shaft holder connected to said transverse bar and extending upwardly and forwardly thereof into said window when said rest is connected to an archery bow, said arrow shaft holder comprising a pair of arcuate arms having front and rear ends, the rear ends of which overlap and the front ends of which are releasably spaced an adjustable distance apart to support an arrow shaft therebetween in said window.

2. The improved arrow rest of claim 1 wherein said arrow shaft holder has a generally horseshoe-shaped configuration.

3. The improved arrow rest of claim 1 wherein said rear ends of said arms are releasably secured together at two spaced points in the overlapping portions thereof, and wherein said rest includes two releasable locking means extending through said overlapping portions at said two spaced points, whereby both said locking means must be unlocked in order to move said front ends of said arms to adjust the distance therebetween.

4. The improved arrow rest of claim 3 wherein locking of just one of said releasable locking means prevents relative movement of said arms, thus assuring improved arm stability.

5. The improved arrow rest of claim 4 wherein said locking means comprise screws passing through aligned openings in said rear ends of said arms and into said bar at said overlapping points.

6. The improved arrow rest of claim 5 wherein said arms are spring biased into said upwardly and forwardly extending position.

7. The improved arrow rest of claim 6 wherein said spring biasing is effected by spring means connected to the free end of said transverse bar, wherein said bar is adjustable transversely and wherein said block is adjustable forwardly and rearwardly.

8. The improved arrow rest of claim 5 wherein each of said arms has a front portion and a rear portion abutting each other forward of said points of overlap, said front portion and said rear portion being connected together for rotation of said front portion relative to said rear portion in order to change the angle of inclination of said arm front ends for improved arrow shaft hoding.

9. The improved arrow rest of claim 8 wherein the abutting ends of said front portion and said rear portion of each of said arms bear click stop means for incrementally rotating said front portion relative to said rear portion and for releasably holding said front portion in a desired rotated position relative to, said rear portion of said arm.

10. The improved arrow rest of claim 5 wherein said arms are relatively inflexible metallic blades.

* * * * *